US005401177A

United States Patent [19]

Dutton et al.

[11] Patent Number: 5,401,177

[45] Date of Patent: Mar. 28, 1995

[54] MASS TERMINATION CONNECTOR BACKSHELL

[75] Inventors: Peter J. Dutton, Union City; Marc W. Piozet, Menlo Park; David C. Pique, Fremont; Lajos J. Vidakovits, Mountain View, all of Calif.

[73] Assignee: Raychem Corporation, Menlo Park, Calif.

[21] Appl. No.: 70,578

[22] Filed: Jun. 1, 1993

[51] Int. Cl.[6] ..... H01R 13/648

[52] U.S. Cl. ..... 439/98; 439/610; 439/905

[58] Field of Search ..... 439/98, 609, 610, 901, 439/905

[56] References Cited

U.S. PATENT DOCUMENTS 3,622,952 11/1971 Hilbert et al. ..... 339/177 R 4,422,710 12/1983 Perona ..... 439/905 X 4,592,612 6/1986 Kikuta ..... 339/143 R

FOREIGN PATENT DOCUMENTS 0473063 3/1992 European Pat. Off. .

9214719 12/1992 Germany .

*Primary Examiner*—Eugene F. Desmond

*Attorney, Agent, or Firm*—Sheri M. Novack; Herbert G. Burkard

[57] ABSTRACT

A mass termination connector (2) having a low profile backshell which may be efficiently stacked. A wiring assembly (24) having conductors (26) extend through a braid (10) and a backshell adapter body (6) to a connector housing (4). The braid is attached to the exterior of the adapter body, removed from the interior compartment, to protect the wiring assembly from chafing during shock and vibration.

18 Claims, 2 Drawing Sheets

MASS TERMINATION CONNECTOR BACKSHELL

The present invention relates to a mass termination connector backshell for electromagnetic energy interference (EMI) shielding.

BACKGROUND OF THE INVENTION

EMI shielding provides protection against interference from electromagnetic energy, including radio frequency interference (RFI). This shielding may be to protect an electronic device from external EMI and RFI or may be to prevent EMI or RFI from escaping from an electrical device, or both.

When a connector is used in an electromagnetic environment, a braid with a backshell is attached, surrounding the conductor bundles to ensure that the interconnection system is compatible with the environment and will work without interference.

For high density applications, multiple piece backshells are required to accommodate the large number of conductor bundles. Because of their shape, handling numerous backshell pieces can be awkward and unwieldy to manipulate and position together in a stable, space-efficient arrangement.

Additionally, where adapters are connected to the cable end of a connector, in applications in which shock and/or vibration are present, the adapter may loosen and cause damage to the connector back end, resulting in further damage to electrical contacts and, perhaps, the electrical system.

SUMMARY OF THE INVENTION

The present invention is directed to mass termination connectors having low profile backshells which may be efficiently stacked. Additionally, the present invention provides a mass termination connector which protects the wire assembly from shock and vibration. The backshell adapter body of the present invention is one piece, including the braid, after the soldering operation.

In one aspect, the present invention provides a mass termination connector comprising:

- a connector housing having an opening therethrough and an outer mating surface formed at one edge of said connector housing surrounding the opening;
- a backshell adapter body having an opening therethrough, a first outer mating surface formed at one edge of said adapter body surrounding the opening and engaging the outer mating surface of said connector housing, being aligned such that the adapter body opening and the connector housing opening together form an interior compartment, and a second outer mating surface formed at an opposite edge of said adapter body surrounding the opening;
- a sleeve capable of retaining a braid between the adapter body and sleeve, said sleeve having an outer mating surface engaging the second outer mating surface; and wherein outside surfaces of the connector housing and adapter body are substantially flush with each other and the outside surface of the adapter body and sleeve are substantially flush with each other.

In the preferred embodiment, the outer mating surfaces of the connector housing, the adapter body and the sleeve are substantially coplanar, each preferably having a substantially rectangular configuration in which the outer profile of each of the mating surfaces has substantially the same dimensions.

The interior compartment of the mass termination connector preferably includes means for receiving an assembly containing a plurality of conductors.

One of the connector housing and adapter body preferably includes a pair of projections and the other of said connector housing and adapter body includes a recess for receipt of said projections. Preferably, the pair of projections is disposed on the connector housing and the recess is formed in the adapter body. The adapter body preferably includes a lip at the interface of the adapter body and sleeve and wherein said sleeve is configured to surround said lip. Thus, the sleeve preferably surrounds the lip, thereby being capable of retaining a braid between the lip and sleeve. The adapter opening, sleeve and braid are configured to allow an assembly containing a plurality of conductors to pass therethrough.

The adapter body may include an extension proximate the first outer mating surface of the adapter body and the outer mating surface of the connector housing, wherein said extension is insertable into said interior compartment. An extension serves to improve EMI shielding capabilities.

Protection of the wiring assembly from shock and vibration by the mass termination connector is effected by removing the wiring assembly from a sharp edge of the backshell. In the preferred embodiment, the braid is retained between the lip and sleeve, preferably removed from the interior compartment.

The present invention preferably includes means for aligning and stacking multiple mass termination connectors, most preferably in the form of at least one hole formed in the connector housing for receipt by a pin.

In a further aspect, the present invention provides a mass termination connector comprising:

- a connector housing having an opening therethrough and an outer mating surface formed at one edge of said connector housing surrounding the opening;
- a backshell adapter body having an opening therethrough, a first outer mating surface formed at one edge of said adapter body surrounding the opening and engaging the outer mating surface of said connector housing, being aligned such that the adapter body opening and the connector housing opening together form an interior compartment, and a second outer mating surface formed at an opposite edge of said adapter body surrounding the opening;
- a sleeve having an outer mating surface engaging the second outer mating surface, said sleeve being capable of retaining a braid between the adapter body and sleeve and spaced from the interior compartment.

The outside surfaces of the connector housing and adapter body are preferably substantially flush with each other and the outside surfaces of the adapter body and sleeve are also preferably substantially flush with each other.

The adapter body preferably includes a lip at the interface of the adapter body and sleeve. The sleeve, thus, preferably surrounds the lip.

Protection of the wire assembly from shock and vibration by the mass termination connector is effected by removing the wire assembly from a sharp edge of the backshell. In the preferred embodiment, the braid is retained between the lip and sleeve, preferably removed from the interior compartment.

Other features and advantages of the present invention will appear from the following description in which the preferred embodiment has been set forth in detail in conjunction with the accompanying drawings.

DETAILED DESCRIPTION OF THE PREFERRED EMBODIMENT

Figure 1:
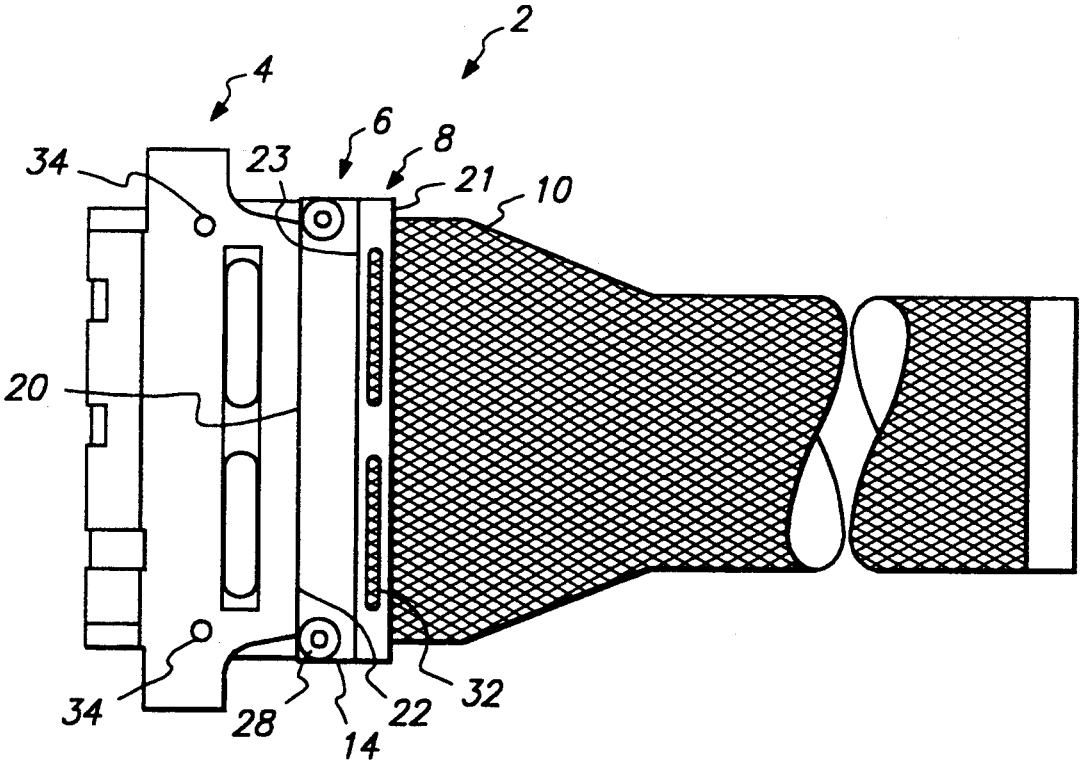
FIG. 1 is a top elevational view of the preferred embodiment of the present invention.

Referring now to the Figures, FIGS. 1–4 illustrate a mass termination connector 2 having a low profile such that multiple mass termination connectors may be efficiently stacked.

A connector housing 4 is affixed to one end of a backshell adapter body 6. At the opposite end of adapter body 6, a sleeve 8 retains a braid 10 between the adapter body and sleeve. Backshell adapter body 6 provides a connection between braid 10 and connector housing 4.

Adapter body 6 is generally rectangular in cross section having an opening 12 formed therethrough. Adapter body 6 includes a main body portion 14, a lip portion 16 and an extension 18. Lip portion 16 extends outwardly from the end of adapter body 6 adjacent and toward sleeve 8, while extension 18 extends outwardly from the opposite end of body 6 toward connector housing 4. Lip portion 16 has a rectangular cross section similar to the cross section of adapter body 6, but slightly smaller, so as to form an edge for receiving sleeve 8. Opening 12 is formed through adapter body 6, including through lip portion 16, main body 14 and extension 18, and has a substantially smooth and uniform cross section throughout the entirety of adapter body 6.

Extension 18 serves to improve EMI shielding capabilities by providing a barrier to EMI, for example, in a more hazardous environment. It should be noted that the present invention may be constructed without extension 18.

Figure 2:
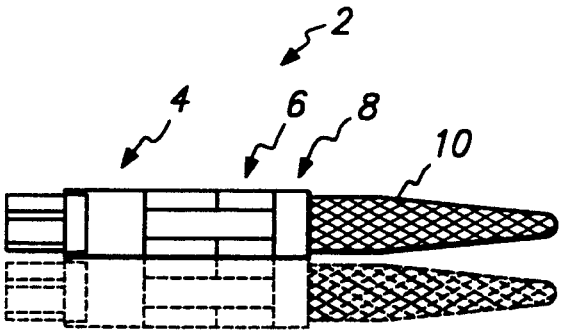
FIG. 2 is a side elevational view of the embodiment of FIG. 1.

Connector housing 4 has a generally fiat configuration with an opening formed therethrough. This opening and opening 12 of adapter body 6 together form an interior compartment for protecting an assembly 24 which contains a plurality of conductors 26. Mating surfaces 20, 22 are formed at the interface of adapter body 6 and connector housing 4, respectively. First outer mating surface 20 formed at one edge of adapter body 6, surrounding opening 12 and engaging outer mating surface 22 of connector housing 4, are aligned such that adapter body opening 12 and the connector housing opening together form an interior compartment. Outer mating surfaces 20, 22 are substantially flush with each other to allow stacking of multiple mass termination connectors. The thickness of adapter body 6 is constructed to be no wider than the thickness of connector housing 4. Similarly, a second outer mating surface 21 is formed at the edge of adapter body 6 opposite first outer mating surface 20 and an outer mating surface 23 is formed at an edge of sleeve 8 mating with second outer mating surface 21. The outer surfaces of connector housing 4, adapter body 6 and sleeve 8 are coplanar, as can be seen in FIG. 2.

In order to maintain a sufficiently secure interface between outer mating surfaces 20, 22, although the face of first outer mating surface 20 surrounding opening 12 has a substantially uniform cross section, a recess (not shown) is formed in each of opposing side faces of outer mating surface 20. Ears (not shown) are located on outer mating surface 22 of connector housing 4. Each ear fits into a respective recess of adapter body 6. Screws 28 are inserted into screwholes 30 of adapter body 6 and extend through the ears of connector housing 4 to securely fasten connector housing 4 and adapter body 6 together. It is, however, within the scope of the present invention to provide alternative means for mating between the connector housing and adapter body.

Figure 3:
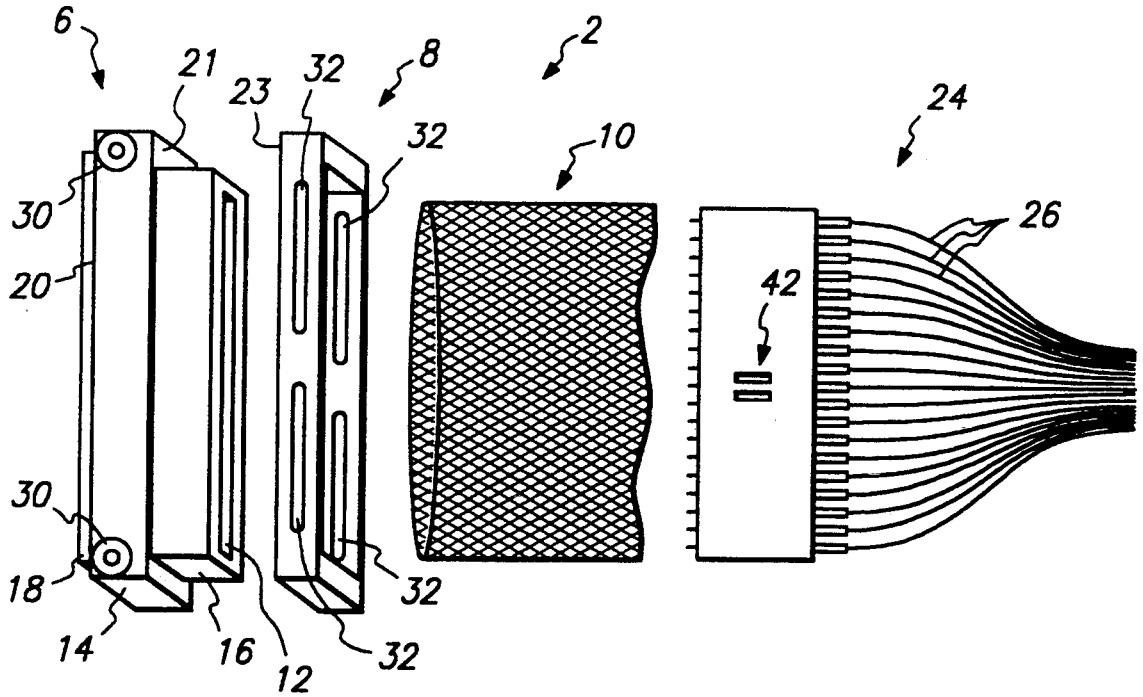
FIG. 3 is an exploded perspective view of preferred embodiment of the present invention.

Sleeve 8 is positioned on second outer mating surface 21 of lip portion 16, surrounding the lip portion, as seen in FIGS. 1 and 3, with braid 10 positioned therebetween such that the braid is removed, or separated, from the interior compartment. In this way, it is possible to protect wire assembly 24 from shock and vibration by the mass termination connector, spacing the wire assembly from any sharp edges of the backshell adapter body or connector housing. Braid 10 is in communication with the interior compartment formed by connector housing 4 and adapter body 6, such that assembly 24, including conductors 26, may be inserted through adapter body 6. Assembly 24 passes freely through the interior compartment of sleeve 8 and adapter body 6 and terminates at the distal end of connector housing 4. Connector housing 4 includes means for retaining the conductor assembly. The means for retaining is preferably in the form of a slot and key arrangement, one of the key and slot being located on assembly 24 and the other on connector housing 4. A slot 42 may be seen on assembly 24 in FIG. 3.

Longitudinal slots 32 are formed in opposite elongated faces of sleeve 8. Preferably, two slots 32 are formed in each of the opposing elongated faces of the sleeve. The slots of the pair are located close to each other and the pair is approximately centered along the face of sleeve 8. As discussed above, braid 10 is clamped between lip 16 of adapter body 6 and sleeve 8. Solder is disposed through slots 32 so as to fixedly maintain the braid in position, removed from the interior compartment.

A pair of holes 34 are formed in connector housing 4 for receipt by a pin or pair of pins (not shown) for neatly and efficiently aligning and stacking multiple mass termination connectors 2. Holes 34 are formed near the periphery of connector housing 4 such that when the pins are inserted through the holes, they do not interfere with wiring assembly 24 or conductors 26. Alternative means may be provided for aligning and stacking mass termination connectors 2, such as a groove formed in the top of a connector housing 4 and a tab formed in the bottom of the connector housing such that the top of one connector housing mates with the bottom of the next connector housing. Other alternative means may be employed for alignment or stacking.

Figure 4:
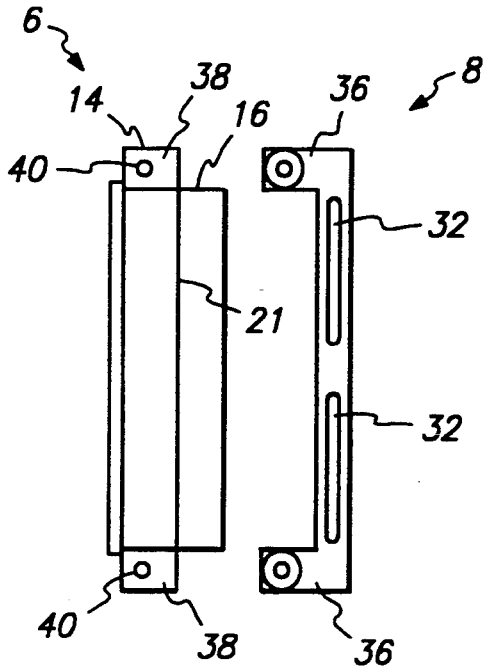
FIG. 4 is a partial plan view of an alternative embodiment of the present invention.

Referring now to FIG. 4, sleeve 8 illustrates an alternate embodiment including projections 36 extending from the main body of the sleeve back toward lip 16 and fitting into depressions 38 formed in main body portion 14 of adapter body 6. Mounting holes 40 may be formed in projections 36 for more securely fastening sleeve 8 to adapter body 6. Mounting holes 40 are positioned over screwholes 30.

In use, in order to terminate a wire assembly 24, mass termination connector 2 is first prepared by sliding a Teflon mandrel inside braid 10 and pre-tinning the braid with solder. Solder coated braid 10 is trimmed with the mandrel in place to keep braid 10 in its proper shape, flush with outer mating surface 23 of adapter sleeve 8. With braid 10 in its shaped condition, the braid is placed over adapter body 6. Sleeve 8 is slid in place, with braid 10 positioned on lip 16, holding the assembly together. Solder strips are positioned over slots 32. High temperature tape is positioned over the solder of slots 32, and the entire mass termination connector 2 is placed in an oven to solder the assembly.

Assembled, adapter body 6 and sleeve 8 provides an interior compartment into which assembly 24, including conductors 26 pass freely through. The interior compartment of connector housing 4 includes means for retaining assembly 24 in place.

Alternatively, as discussed with respect to FIG. 4, above, sleeve 8 may include projections 36 for placement within depression 38.

Variations and modifications can be made to the preferred embodiment without departing from the scope of the present invention, which is limited only by the following claims.

What is claimed is:

1. A mass termination connector comprising:

a connector housing having an opening therethrough and an outer mating surface formed at one edge of said connector housing surrounding the opening;

a backshell adapter body having an opening therethrough, a first outer mating surface formed at one edge of said adapter body surrounding the opening and engaging the outer mating surface of said connector housing, being aligned such that the adapter body opening and the connector housing opening together form an interior compartment, and having a second outer mating surface formed at an opposite edge of said adapter body surrounding the opening;

a sleeve capable of retaining a braid between the adapter body and sleeve, said sleeve having an outer mating surface engaging the second outer mating surface; and wherein the outside surfaces of the connector housing and adapter body are substantially flush with each other and the outside surfaces of the adapter body and sleeve are substantially flush with each other.

2. The mass termination connector as defined in claim 1 wherein outside surfaces of the connector housing, the adapter body and the sleeve are substantially coplanar.

3. The mass termination connector as defined in claim 1 wherein said connector housing, adapter body and sleeve each have a substantially rectangular configuration, the outer profile of the respective mating surfaces having substantially the same dimensions.

4. The mass termination connector as defined in claim 1 wherein one of said connector housing and said adapter body includes a pair of projections and wherein the other of said connector housing and adapter body includes a recess for receipt of said projections.

5. The mass termination connector as defined in claim 4 wherein said connector housing includes said pair of projections and wherein said adapter body includes said recess.

6. The mass termination connector as defined in claim 1 wherein said adapter body includes a lip at the interface of the adapter body and sleeve and wherein said sleeve is configured to surround said lip.

7. The mass termination connector as defined in claim 6 wherein said lip is capable of retaining the braid between said lip and said sleeve.

8. The mass termination connector as defined in claim 7 wherein the lip and portion of sleeve for retaining the braid is removed from the interior compartment.

9. The mass termination connector as defined in claim 8 wherein the adapter body opening, sleeve and braid are configured to allow an assembly containing a plurality of conductors to pass therethrough.

10. The mass termination connector as defined in claim 1 wherein said adapter body includes an extension proximate the first outer mating surface of the adapter body and the outer mating surface of the connector housing, wherein said extension is insertable into said connector housing.

11. The mass termination connector as defined in claim 1 further comprising means for aligning and stacking multiple mass termination connectors.

12. The mass termination connector as defined in claim 11 wherein said means for aligning and stacking comprises a hole formed in the connector housing for receipt by a pin.

13. The mass termination connector as defined in claim 1 further comprising means for receiving an assembly containing a plurality of conductors.

14. A mass termination connector comprising:

a connector housing having an opening therethrough and an outer mating surface formed at one edge of said connector housing surrounding the opening;

a backshell adapter body having an opening therethrough, a first outer mating surface formed at one edge of said adapter body surrounding the opening and engaging the outer mating surface of said connector housing, being aligned such that the adapter body opening and the connector housing opening together form an interior compartment, and having a second outer mating surface formed at an opposite edge of said adapter body surrounding the opening;

a sleeve having an outer mating surface engaging the second outer mating surface, said sleeve being capable of retaining a braid between the adapter body and sleeve and spaced from the interior compartment.

15. The mass termination connector as defined in claim 14 wherein the outside surfaces of the connector housing, adapter body and sleeve are substantially flush with each other.

16. The mass termination connector as defined in claim 14 wherein said adapter body includes a lip at the interface of the adapter body and sleeve and wherein the sleeve is configured to surround the lip.

17. The mass termination connector as defined in claim 16 wherein said lip is capable of retaining the braid between said lip and said sleeve.

18. The mass termination connector as defined in claim 17 wherein the lip and portion of sleeve for retaining the braid is separated from the interior compartment.

* * * * *